US005446951A

United States Patent [19]

Takeuchi et al.

[11] Patent Number: 5,446,951

[45] Date of Patent: Sep. 5, 1995

[54] DEVICE FOR MEASURING AND CONTROLLING RUNNING DISTANCE OF A YARN

[75] Inventors: Keisho Takeuchi, Kanazawa; Kiyoshi Nakade, Komatsu, both of Japan

[73] Assignee: Tsudakoma Kogyo Kabushiki Kaisha, ishikawa, Japan

[21] Appl. No.: 63,869

[22] Filed: May 18, 1993

[30] Foreign Application Priority Data

May 18, 1993 [JP] Japan ..... 4-125146

[51] Int. Cl.[6] ..... D02H 13/10

[52] U.S. Cl. ..... 28/187; 28/185; 139/370.2; 242/36; 242/534

[58] Field of Search ..... 19/0.25, 0.26; 28/185, 28/186, 187; 66/160, 161, 162, 163, 164, 158; 242/36, 37, 39, 523.1, 534, 534.2; 139/370.2; 364/470

[56] References Cited

U.S. PATENT DOCUMENTS

| | | | |
|---|---|---|---|
| 3,938,750 | 2/1976 | Barnes et al. | 242/36 |
| 4,038,127 | 7/1977 | Bullock, Jr. et al. | 242/534 X |
| 4,074,404 | 2/1978 | Schenk | 28/185 |
| 4,455,549 | 6/1984 | Rydborn | 28/185 X |
| 4,535,949 | 8/1985 | Olsson | 242/534 X |
| 4,607,804 | 8/1986 | Urlik | 242/534 X |
| 4,915,314 | 4/1990 | Colli et al. | 242/36 X |
| 4,924,917 | 5/1990 | Shaw | 139/370.2 X |
| 4,941,240 | 7/1990 | Denzler et al. | 28/187 |
| 4,942,909 | 7/1990 | Ghiardo | 139/370.2 |
| 5,295,287 | 3/1994 | Chateau | 28/187 |

FOREIGN PATENT DOCUMENTS

| | | | |
|---|---|---|---|
| 0503238A1 | 1/1993 | European Pat. Off. . | |
| 5846576 | 10/1983 | Japan . | |
| 661946A5 | 10/1983 | Switzerland . | |
| 1391675 | 4/1975 | United Kingdom | 242/75.51 |

*Primary Examiner*—John J. Calvert

*Attorney, Agent, or Firm*—Christopher R. Pastel; Thomas R. Morrison

[57] ABSTRACT

A device for measuring running distance of a yarn, which detects an abnormality in yarn moving along a path of travel past a means for detecting the abnormality. The measuring device is capable of generating a stop signal in response to detecting the abnormality and measures the distance travelled following the generation of the stop signal. The location of the abnormality is indicated by various means including a plurality of lamps and numerics display. Further, the device can stop the abnormality at a predetermined distance.

3 Claims, 6 Drawing Sheets

DEVICE FOR MEASURING AND CONTROLLING RUNNING DISTANCE OF A YARN

BACKGROUND OF THE INVENTION

1. Field of the Invention

The present invention relates to a warper and, more precisely, to a device for measuring the running distance of a yarn, and a stop control device for a warper which ascertains an abnormal portion in a yarn and facilitates the repair of the abnormal portion in the yarn.

2. Description of the Prior Art

A warper referred to herein is a machine used for evenly arranging a desired number of yarns at prescribed intervals (a "warp") and taking them up around a drum or a warp beam while applying a prescribed tension on each yarn. The number of yarns, the dimension of intervals, the degree of tension and such other conditions are appropriately set to weave fabric.

When an abnormality, such as fluff or breakage, occurs in a yarn, it is necessary that a warper be halted automatically and the yarn immediately repaired, since an abnormality may cause problems such as hindering the weaving process or deteriorating the quality of a fabric.

Repairing abnormal yarns in a warper is not an easy operation. A yarn continues to run a considerable distance due to inertia from the time of detection of an abnormality until the warper stops. The running distance from the time of detection of an abnormality varies and depends on parameters such as the wind-up diameter of the warp beam and the running speed of the warper. Therefore, it is not easy to find the location of the abnormality in a yarn (hereinafter simply referred to as "abnormality"), after the warper stops.

With regard to the above problem, Japanese Laid-Open Patent Publication No. 46576/1983 discloses a method for simplifying the repair operation by controlling the running distance of a yarn from the time of detection of an abnormality until the warper stops so that the location of the abnormality is always the same after the warper has halted. The invention disclosed in the above mentioned Patent Publication calls for detecting the wind-up diameter of the warp beam and the running speed of the warper and controlling the brake of the warper. Based on the data detected, one can control the braking force of the warper as to make the running distance of the yarn constant. The desired braking force is calculated based on the moment of inertia of the warp beam and the running speed of the warper.

As a rule, the braking force of a brake cannot be drastically changed. Therefore, the conventional art described above presents a problem because it is extremely difficult to stop the warper in such a manner so that the site of the abnormality is always at the same position. This is because a brake used in a warper is usually a mechanical brake consisting of a brake shoe and a brake drum, and it is extremely difficult to precisely produce an intermediate braking force of desired magnitude even though the force applied to the brake shoe can be controlled. This problem may be overcome by using an eddy-current brake or a similar device which is capable of producing any desired braking force. On the other hand, using an eddy current brake or similar device makes the entire machine very expensive to fabricate.

OBJECT AND SUMMARY OF THE INVENTION

Accordingly, it is an object of the present invention to provide a device which is incorporated in a warper for measuring the running distance of yarns and making the process of locating an abnormality considerably easier, while using a mechanical brake of a standard type. The measuring device has means for measuring the distance travelled by an abnormality after detection and means for displaying the measured yarn running distance.

Another object of the present invention is to provide a brake control device of a warper which uses the measuring means.

Briefly stated, a yarn running distance measuring device of a warper according to a feature of the present invention comprises an abnormality detection means which detects abnormalities in yarns set on a warper and produces stop signals, a measuring means for measuring the distance travelled by the yarn from the actuation of the abnormality detection means until the warper stops and an indicator for displaying the yarn running distance calculated by the measuring means.

According to another feature of the present invention, there is provided a brake control device of a warper which principally comprises an abnormality detection means and a measuring means, which both have the same structure as those of the aforementioned first feature of the present invention, and a control circuit for controlling a drive motor and a brake of the warper so that the yarn running distance calculated by the measuring means is always of a desired value.

According to the above first feature of the present invention, when a warper is in operation, the abnormality detection means detects an abnormality in a yarn and produces a stop signal so that, in response to the stop signal, the warper cuts the power supply to the drive motor and actuates the brake, thereby halting its operation immediately. Meanwhile, the measuring means measures the distance which the yarn has travelled from the actuation of the abnormality detection means until the warper stops, and the indicator displays the measured running distance which corresponds to the location of the abnormal portion of the yarn in the warp. Thus, an apparatus of the present invention permits an operator of the warper to easily locate the site of the abnormality and start its repair procedure.

The indicator mentioned above is not limited to a type which indicates the running distance via a digital display. For example, it may be of a type wherein a plurality of indicator lamps are arranged on the warper in the running direction of the warp, wherein the one corresponding to the location of the abnormality is lit among the plurality of indicator lamps.

According to the above second feature of the present invention, the control circuit controls the drive motor and the brake of the warper so that the running distance is constant (in other words the location of the abnormality at the time the warper stops is always the same), thereby making searching operation of the abnormality even easier.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
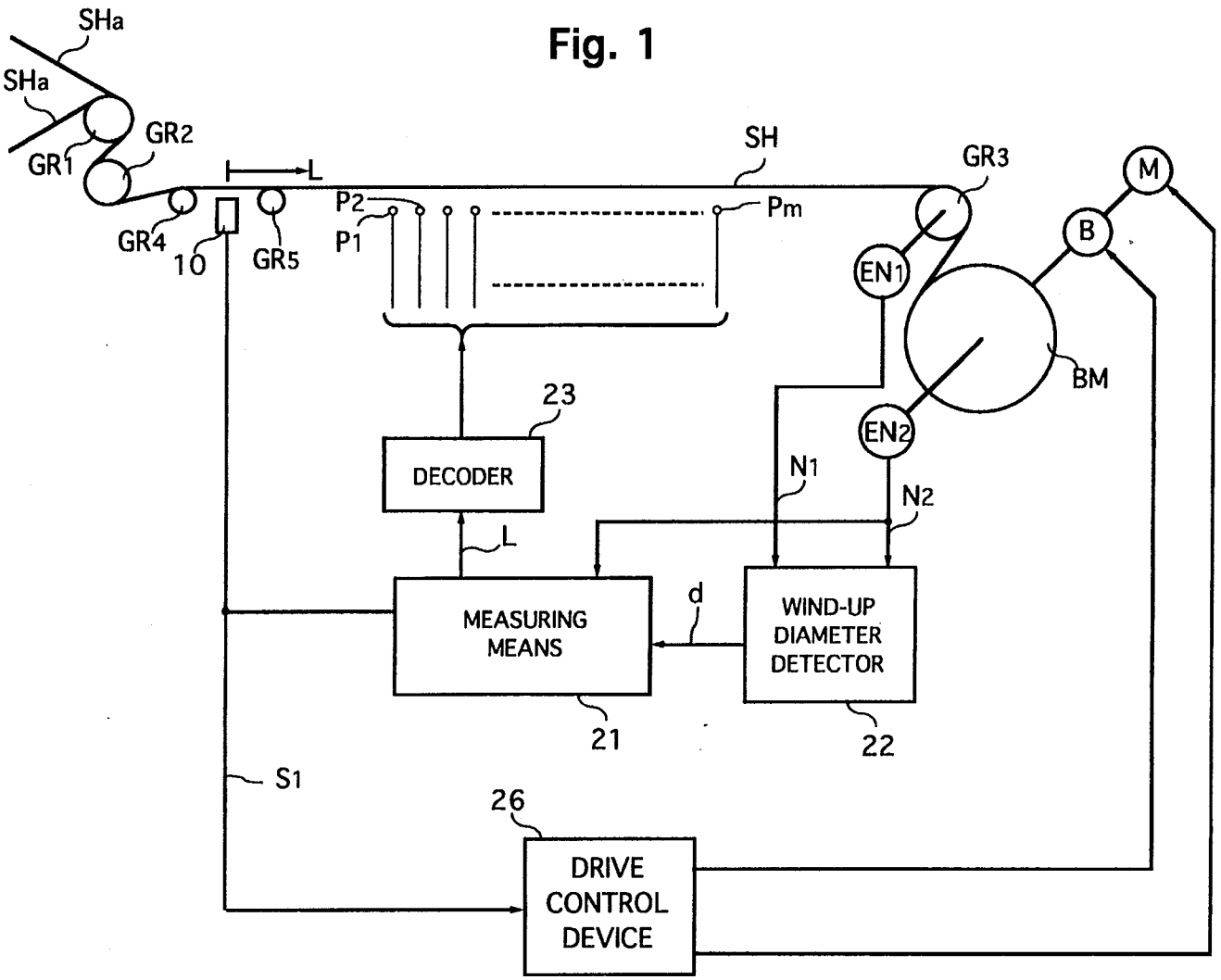
FIG. 1 is an explanatory drawing illustrating the general structure of an embodiment of the present invention.

Referring to FIG. 1, a running distance measuring device of a warper comprises an abnormality detection means 10, a measuring means 21 and indicators $P_i(i=1, 2, \ldots, m)$.

A warper comprises guide rollers $GR_1/GR_2$ at the upstream side, a measuring roller $GR_3$ at the downstream side and a warp beam BM. On guide roller $GR_1$, numerous yarns SHa/SHa/ . . . pulled out of a creel (not shown) are arranged in parallel and formed into a warp SH. Warp SH passes through guide rollers $GR_1/GR_2$ and measuring roller $GR_3$ and is then taken up by warp beam BM. Warp beam BM is connected to a brake B and a drive motor M. Respectively connected to measuring roller $GR_3$ and warp beam BM are rotary encoders $EN_1/EN_2$ for measuring numbers $N_1$, $N_2$ of revolutions of measuring roller $GR_3$ and warp beam BM respectively.

Abnormality detection means 10 is, for example, a fluff detector which detects fluff in a yarn SHa contained in warp SH by means of projecting laser beams across warp SH and receiving the reflected beams. Abnormality detection means 10 is configured to produce a stop signal $S_1$ when it detects an abnormal yarn in warp SH. Auxiliary guide rollers $GR_4/GR_5$ for regulating the moving range of warp SH, thereby stabilizing the operation of abnormality detection means 10, are respectively provided at the upstream side and the downstream side of abnormality detection means 10.

Stop signal $S_1$ from abnormality detection means 10 is output to a drive control device (not shown) of the warper and also sent to measuring means 21.

Measuring means 21 is provided with a wind-up diameter detector 22 to which output ends of rotary encoders $EN_1/EN_2$ are respectively connected. In addition to the output of rotary encoder $EN_2$, which is branched and separately connected to measuring means 21 and wind-up diameter detector 22, the output of wind-up diameter detector 22 is connected to measuring means 21. The output of measuring means 21 is connected through a decoder 23 to indicators $P_i$. In the case of the present embodiment, however, indicators $P_i$ comprise m number of indicator lamps arranged in the direction of movement of warp SH.

When the diameter of measuring roller $GR_3$ is represented by $d_3$ and the wind-up diameter of warp beam BM is represented by d, $$\pi d_3 N_1 = \pi d N_2.$$

Therefore, wind-up diameter detector 22 is able to calculate the wind-up diameter d of warp beam BM based on the equation:

$$d = d_3(N_1/N_2)$$

and output the result to measuring means 21.

As stop signal $S_1$ and number of revolutions $N_2$ of warp beam BM are respectively input from abnormality detection means 10 and rotary encoder $EN_2$, measuring means 21 calculates yarn running distance L after the actuation of abnormality detection means 10 by reading the number of revolutions $N_2$ of warp beam BM from the time stop signal $S_1$ is output until the warper actually stops. L is given by:

$$L = \pi d N_2.$$

In this case, however, when stop signal $S_1$ is output to drive control device 26, drive control device 26 halts the entire machine immediately by cutting off the power supply to drive motor M and actuating brake B. It is also a condition that yarn running distance L is measured in the moving direction of warp SH, starting from the position of abnormality detection means 10. Therefore, yarn running distance L represents the distance which an abnormal portion detected by abnormality detection means 10 travels on the warper during the braking period, i.e., until the warper stops.

Measuring means 21 outputs the obtained yarn running distance L to decoder 23. Since decoder 23 is capable of lighting a one of the plurality of indicators $P_i$, i.e., the one corresponding to yarn running distance L, the operator can find the abnormal yarn easily by searching the vicinity of the lit indicator $P_i$ and then repair the abnormal yarn.

Wind-up diameter d of warp beam BM gradually increases while the warper is operated and wind-up diameter detector 22 correctly calculates wind-up diameter d at any time according to the increase, by using, for example, the mean value of the results of calculations done at present. Consequently, measuring means 21 can also correctly calculate yarn running distance L by using the value of wind-up diameter d calculated as above and the number of revolutions $N_2$ of warp beam BM.

Where L can be defined as $$L = \pi d N_2 = \pi d_3(N_1/N_2)N_2 = \pi d_3 N_1,$$

measuring means 21 is able to calculate yarn running distance L by merely using the number of revolutions $N_1$ of measuring roller $GR_3$. However, the number of revolutions $N_1$ is not always accurately detected, especially in cases where warp SH slips on measuring roller $GR_3$. As a rule, it is desirable for measuring means 21 to have a configuration such as is shown in FIG. 1, but when slippage of warp SH on measuring roller $GR_3$ can be ignored, wind-up diameter detector 22 may be omitted so that yarn running distance L is calculated based solely on the number of revolutions $N_1$ of measuring roller $GR_3$.

Indicators $P_i$ shown in FIG. 1 may be replaced by a dot matrix or segment type digital display which numerically displays yarn running distance L. For example, a scale provided on the warper for indicating yarn running distance L permits an operator to easily ascertain the location of the abnormality by measuring yarn running distance L, which is then displayed on the digital display.

Figure 2:
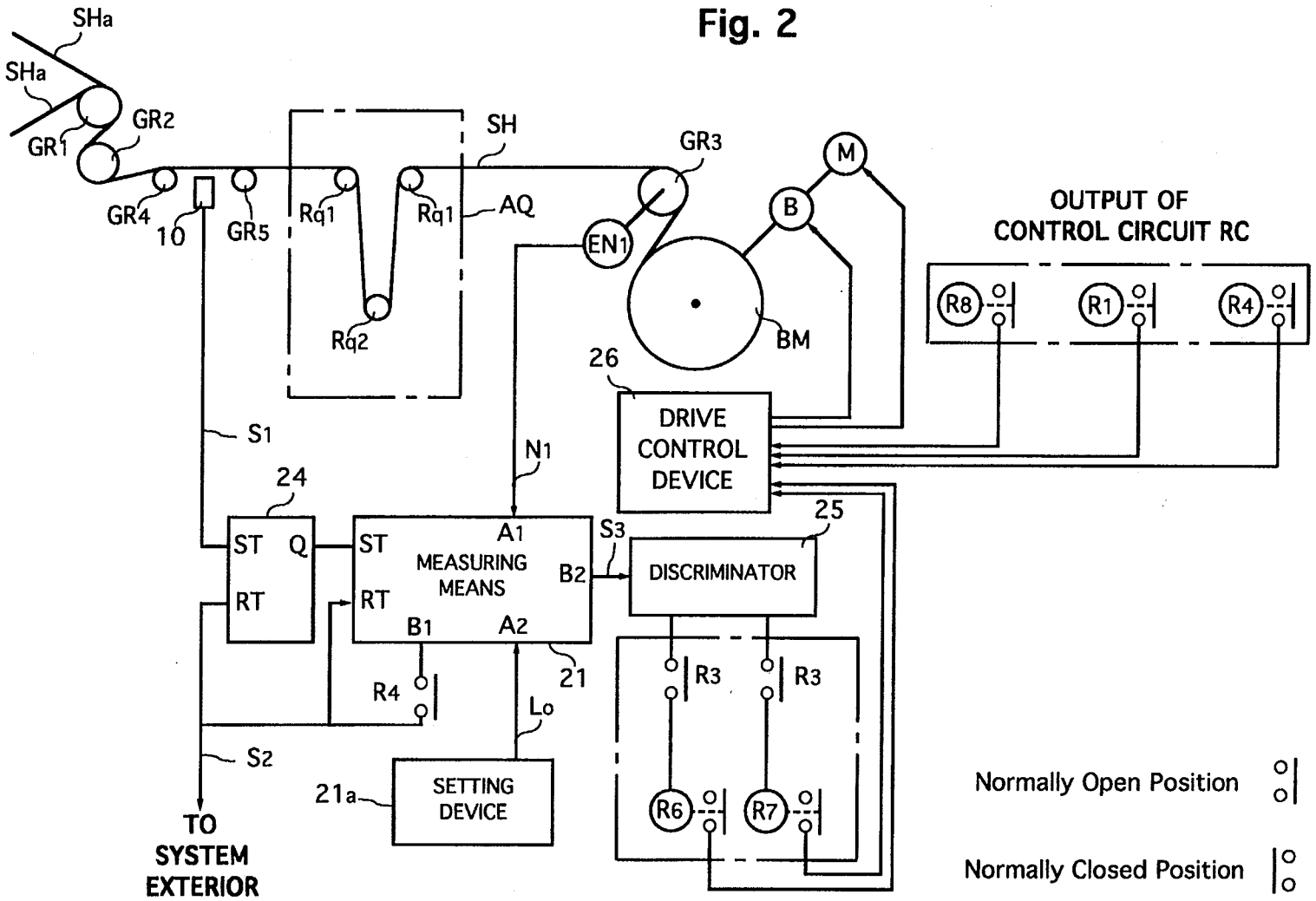
FIG. 2 illustrates another embodiment of the present invention and corresponds to FIG. 1.
Figure 3:
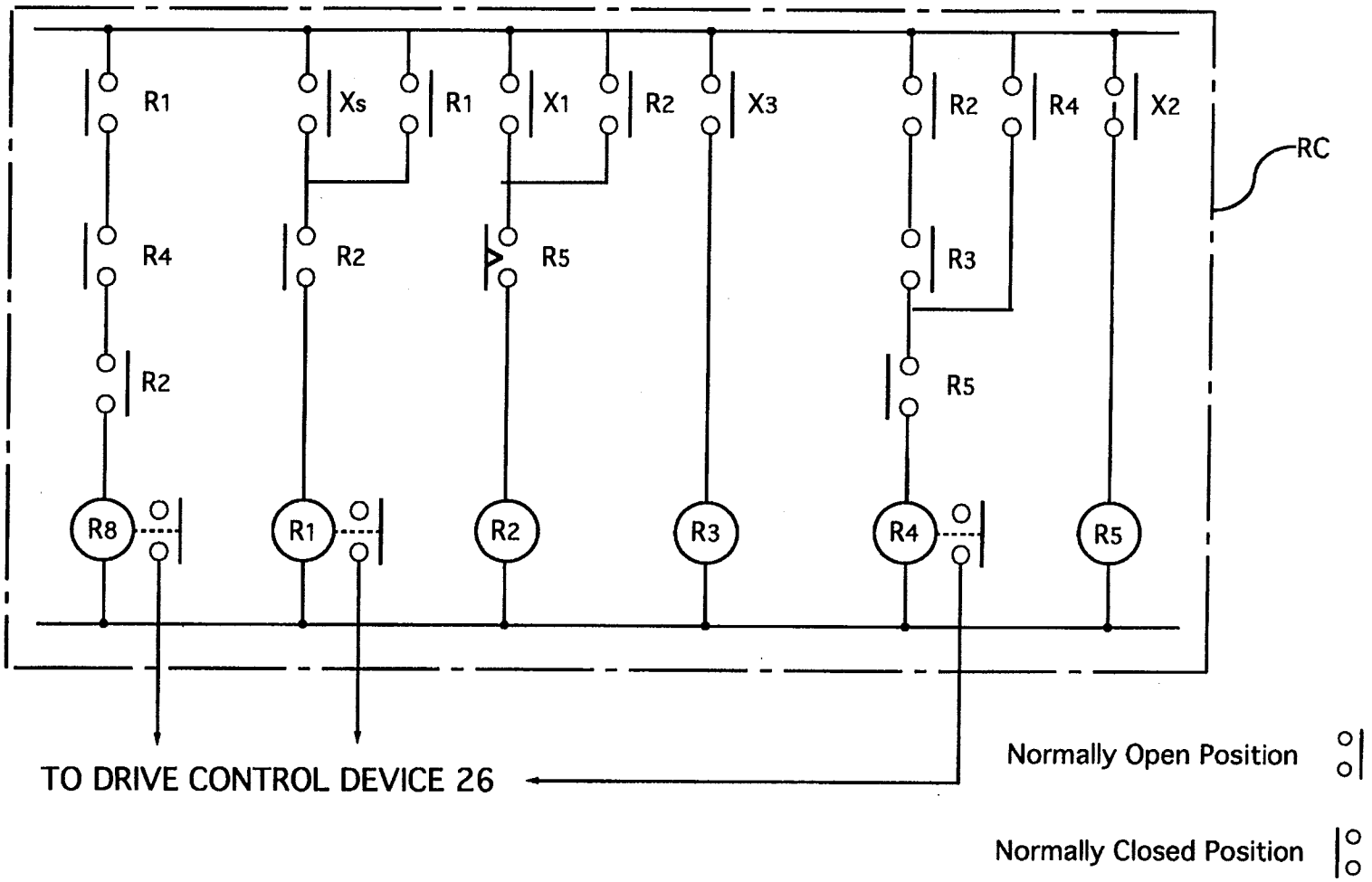
FIG. 3 is a wiring diagram illustrating the control circuit of a second embodiment of the present invention.

Referring to FIGS. 2 and 3, a device for controlling stoppage of a warper can be formed by combining a measuring means 21 and a control circuit RC for controlling drive motor M and brake B of the warper so as to make yarn running distance L a prescribed value $L_0$. In this case, the warper has an accumulator AQ which consists of guide rollers $Rq_1/Rq_1$ and a dancer-roller $Rq_2$. Accumulator AQ is positioned between abnormality detection means 10 and measuring roller $GR_3$.

Stop signal $S_1$ from abnormality detection means 10 is input to a set terminal ST of a flip-flop 24. An output terminal Q of flip-flop 24 is connected to a set terminal ST of measuring means 21. The number of revolutions $N_1$ of measuring roller $GR_3$ is input from rotary encoder $EN_1$ to input terminal $A_1$ of measuring means 21. The prescribed value $L_0$ is input from a setting device 21*a* to input terminal $A_2$ of measuring means 21. Prescribed value $L_0$ referred to herein is a target value set in setting device 21*a* in relation to running distance $L=\pi d_3 N_1$ calculated by measuring means 21 based on the number of revolutions $N_1$.

Re-stop signal $S_2$ is output from an output terminal $B_1$ of measuring means 21 and conveyed through a normally open contact of a relay $R_4$ to the exterior of the system. Re-stop signal $S_2$ is also input to each reset terminal RT of flip-flop 24 and measuring means 21. Connected to output terminal $B_2$ of measuring means 21 is a discriminator 25, to which relays $R_6/R_7$ are connected through normally open contacts of respective relays $R_3$.

Control circuit RC has a relay $R_1$ for high-speed operation of the warper, a relay $R_8$ for braking, and control relays $R_2/R_3/R_4/R_5$. Relay contact $X_s$ represents a normally open contact of a relay (not shown) which operates in response to an operation switch of the warper. Relay contacts $X_1/X_2$ represent normally open contacts of relays (not shown) which respectively operate in response to stop signal $S_1$ and re-stop signal $S_2$. Relay contact $X_3$ is a contact of a speed detection relay of the warper, which is automatically switched "on" when the running speed of the warper approaches zero.

When an operation switch (not shown) of the warper is operated, relay contact $X_s$ is closed and therefore relay $R_1$ holds itself. As a result, when power is supplied to drive motor M, the warper accelerates in accordance with a prescribed acceleration line and enters the high speed operation state at a desired speed. At that time, relay $R_8$ becomes non-excited due to the actuation of relay $R_1$, thereby releasing brake B. In other words, the contacts of relays $R_1$ and $R_8$ are connected to a drive control circuit (not shown) of the warper and used to control drive motor M and brake B.

Figure 4:
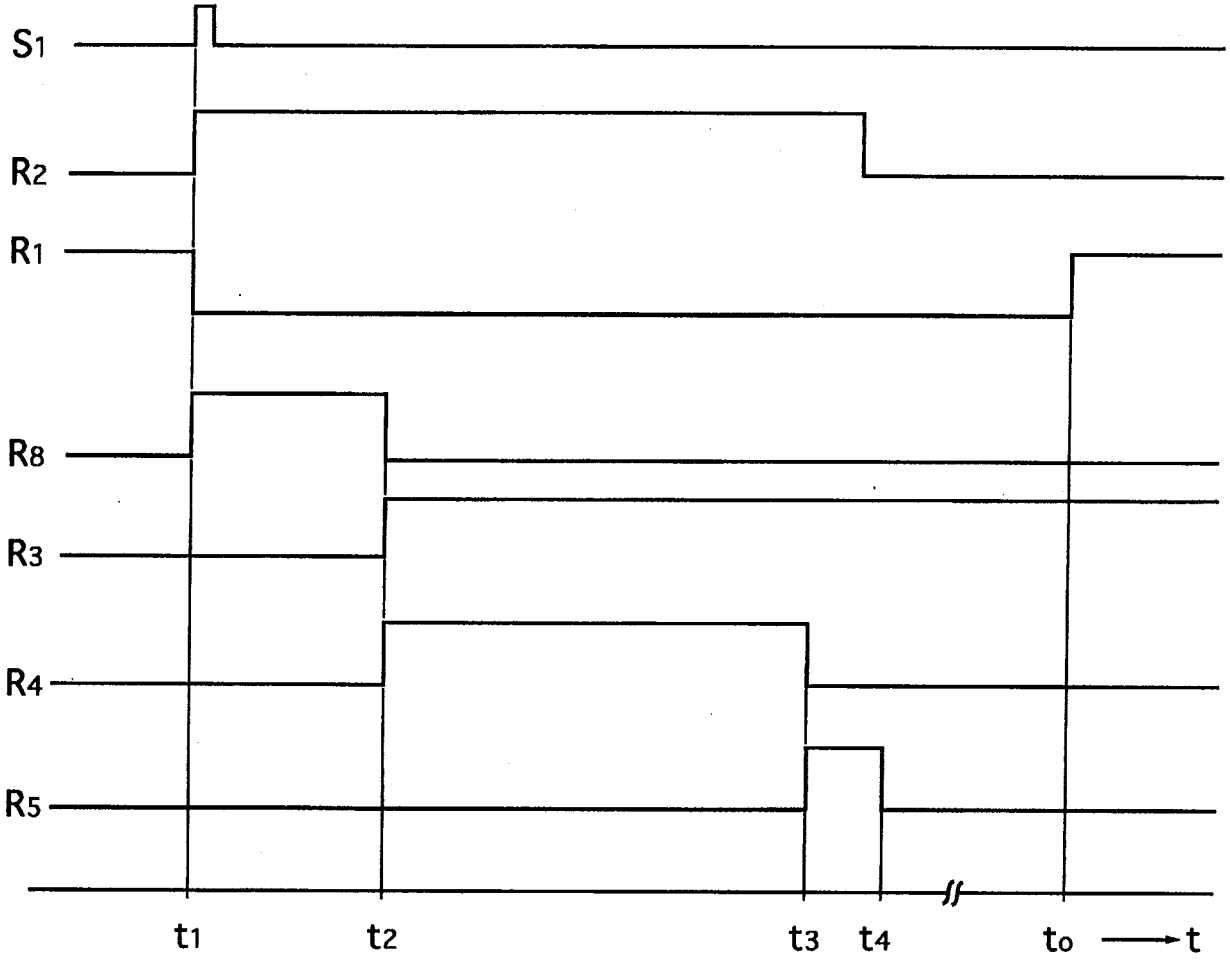
FIG. 4 is a time chart illustrating an operation of the second embodiment of the present invention.
Figure 5:
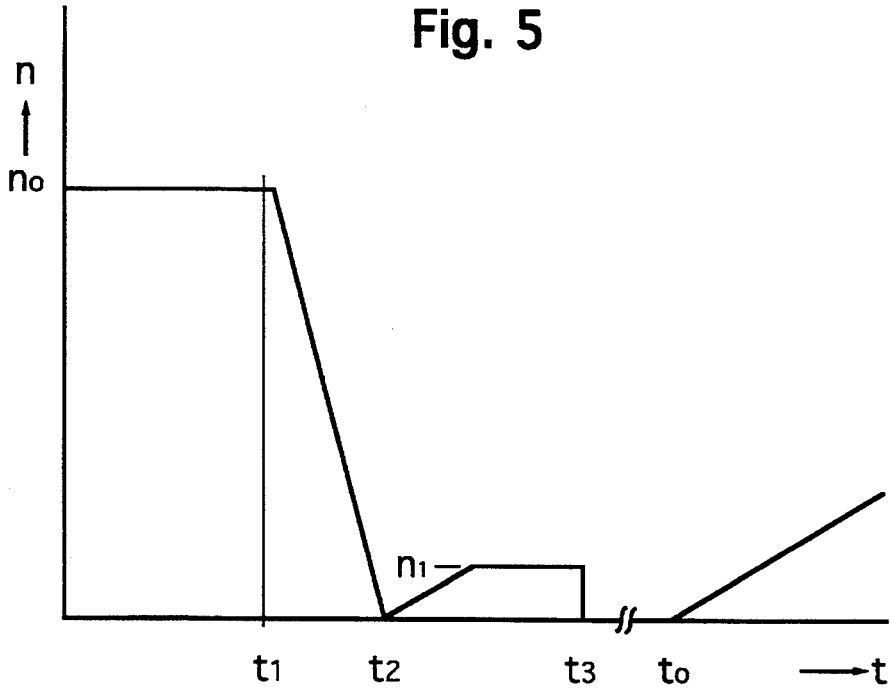
FIG. 5 is an explanatory drawing illustrating operation of the second embodiment of the present invention.

Referring also to FIGS. 4 and 5, when abnormality detection means 10 generates stop signal $S_1$ while the warper is in its high speed operation stage at the running speed of $n=n_0$, relay contact $X_1$ is closed at time $t=t_1$, thereby actuating relay $R_2$. As relay $R_1$ is reset and relay $R_8$ is closed as a result of the actuation of relay $R_2$, power to drive motor M is cut off and brake B is actuated. Therefore, the warper immediately slows down according to a speed reduction curve determined by the braking force of brake B.

Since flip-flop 24 is set by stop signal $S_1$, measuring means 21 is able to initiate the measurement of yarn running distance $L=\pi d_3 N_1$ from the time of output of stop signal $S_1$, compare it with specified value $L_0$, and output the result of the comparison through output terminals $B_1/B_2$. At that time measuring means 21 serves as a kind of pre-set counter and initiates a measuring operation when set terminal ST turns high level. Output terminal $B_1$ is switched to the high level when L is equal to $L_0$, and output terminal $B_2$ sends comparison signal $S_3$ indicating whether L is greater or smaller than $L_0$ ($L>L_0$ or $L<L_0$).

When the running speed n of the warper approaches 0 at time $t=t_2$, relay contact $X_3$ is closed. As relay $R_3$ becomes active as a result of closing relay contact $X_3$, relay $R_4$ becomes active and relay $R_8$ is returned, thereby releasing brake B. If the normally open contact of relay $R_4$ serves as a command signal to the drive control circuit in order to restart the warper at a low speed, with running speed $n=n_1<<n_0$ as the target speed, it is possible to restart the warper afterwards by means of relay $R_4$ and permit it to continue running at a low speed, provided that discriminator 25 confirms that L is less than $L_0$, based on comparison signal $S_3$ from measuring means 21, and then actuates relay 6 which controls low-speed operation in the forward direction. Therefore, in response to the actuation of relays $R_4/R_6$, the drive control device restarts drive motor M in the forward direction.

When measuring means 21 detects that L is equal to $L_0$ during the low-speed operation described above, its output terminal $B_1$ turns high level, and re-stop signal $S_2$ is generated. Re-stop signal $S_2$ actuates relay $R_5$ through relay contact $X_2$, and the normally closed contact of relay $R_5$ returns relay $R_4$. Therefore, as a result of the restart of brake B, the warper is stopped to make running distance L correspond to the prescribed value $L_0$ at time $t=t_3$. In this case, however, relay $R_2$ must be reset by the on-delay type normally closed contact of relay $R_5$ somewhat later than the actuation of relay $R_5$.

Since re-stop signal $S_2$ also resets flip-flop 24 and measuring means 21 at the same time, re-stop signal $S_2$ itself immediately disappears thereafter, causing relay $R_5$ to be also returned. Thus, the entire machine returns to the initial state at time $t=t_4$, permitting the operator to conduct desired repair operations and to restart the warper at high speed at time $t=t_0$.

In cases where measuring means 21 detects the condition $L>L_0$ when $t=t_2$, discriminator 25 actuates relay $R_7$ based on comparison signal $S_3$ output from measuring means 21. Relay $R_7$ commands low speed operation in the reverse direction instead of relay $R_6$. As a result of the actuation of relays $R_4$ and $R_7$, the drive control device restarts the warper in the reverse direction. At that time, although warp SH naturally sags between guide roller $GR_2$ and measuring roller $GR_3$, accumulator AQ is able to prevent yarns SHa/SHa/. . . that constitute warp SH from becoming tangled together by absorbing the sagging. Although measuring means 21 detects the condition $L=L_0$ during the period from $t=t_1$ to $t=t_2$, there is no danger of re-stop signal $S_2$ being erroneously output since relay $R_4$ has not yet been actuated.

Generally speaking, it is preferable to set prescribed value $L_0$ of running distance L in measuring means 21 so that $L_0>L_a$ in order to prevent the abnormal portion detected by abnormality detection means 10 from being taken up by warp beam BM before the warper finally stops. "$L_a$" referred to above represents the length of the portion of warp SH from abnormality detection means 10 to warp beam BM. It is also preferable to set the braking force of brake B to permit the warper which is under high speed operation to stop while maintaining the condition $L<L_0$. In cases where the braking force of brake B is set as above, there is no need to restart the warper in the reverse direction. Restarting it slowly in the forward direction is sufficient. Therefore, accumulator AQ may be omitted. Furthermore, in the same manner as in the first embodiment described above, measuring means 21 according to this embodiment may be provided with indicator $P_i$ for displaying measured running distance L and may calculate yarn running distance L based on wind-up diameter d and the number of revolutions $N_2$ of warp beam BM.

Figure 6:
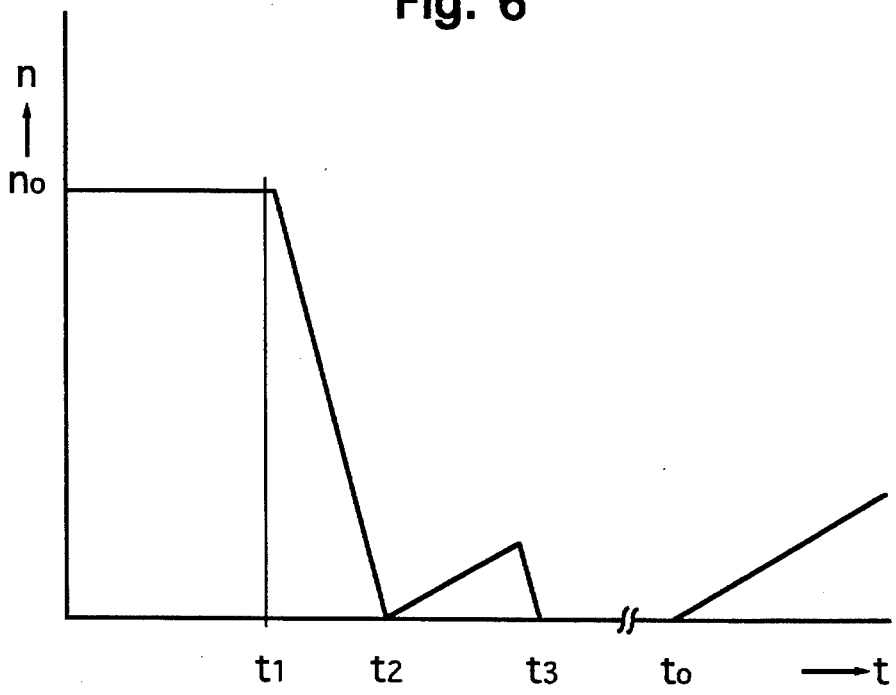
FIG. 6 corresponds to FIG. 5 and illustrates another operation of the control circuit.

Referring to FIG. 6, drive motor M may be restarted at time $t=t_2$ so as to accelerate the warper according to the acceleration line to put it at normal high speed operation instead of low speed operation. Generally speaking, the grade of the aforementioned acceleration line is gentle, and the degree of compensation movement $\Delta L=|L-L_0|$ during the period from $t=t_2$ to $t=t_3$ is not significant. Therefore, even if the usual acceleration line is used, the operation speed n when the value of L becomes $L_0$ at the time $t=t_3$ is not high, and consequently, brake B is able to stop the warper soon again.

Figure 7:
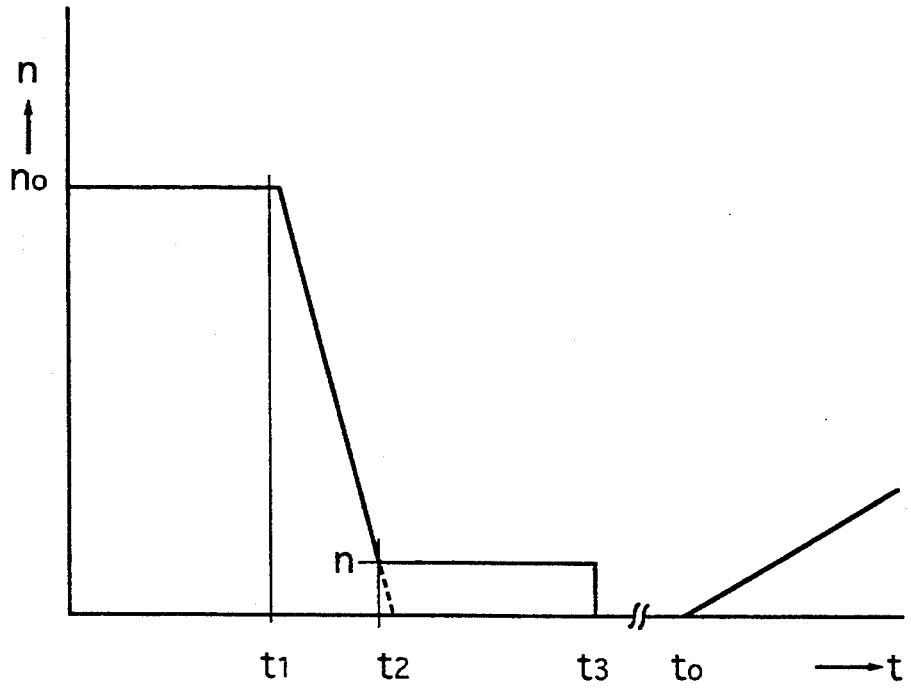
FIG. 7 corresponds to FIG. 5 and illustrates a further operation of the control circuit.

Referring to FIG. 7, when operation speed n is reduced to $n=n_1$ at the time $t=t_2$, brake B may be released to permit the warper to continue to run due to inertia and may be re-actuated upon detection by measuring means 21 of $L=L_0$ at time $t=t_3$, thereby stopping the warper. As re-starting operation at a low speed is not necessary, control circuit RC can be simplified. In that case, however, brake B must stop the warper in its high-speed operation phase while maintaining the condition $L<L_0$.

During the coasting phase from $t=t_2$ to $t=t_3$ in FIG. 7, the warper may alternatively be switched to low-speed mode. In other words, the warper may be operated in any desired mode as long as control circuit RC is capable of appropriately controlling the timing of the actuation of drive motor M and brake B so that the yarn running distance L measured by measuring means 21 equals $L_0$.

Instead of rotary encoders $EN_1/EN_2$, measuring means 21 may use a laser doppler sensor or some other sensor which is capable of directly detecting the running speed of warp SH in order to measure running distance L. Furthermore, in cases where detection lag $\Delta T$ from the time of detection of the abnormality by abnormality detection means 10 until the time of output of stop signal $S_1$ cannot be ignored, measuring means 21 may calculate the yarn running distance L based on the equation $L=L+L_b$, with the travelled distance $L_b$ travelled by warp SH in the period being taken into consideration. Travelled distance $L_b$ can be found from such an equation as, for example, $L_b=\pi\Delta N_2$, wherein $\Delta N_2$ represents the number of revolutions $N_2$ of warp beam BM during detection lag $\Delta T$.

The present invention also applies to repairing broken yarn by using a broken yarn sensor which is capable of detecting a broken yarn in yarns SHa/SHa/. . . constituting warp SH and serves as abnormality detection means 10. For example, abnormality detection means 10 may be positioned at the upstream side of guide rollers $GR_1/GR_2$ in a creel from which yarns SHa/SHa/. . . are drawn. In that case, running distance L is also measured from the position of abnormality detection means 10.

Furthermore, abnormality detection means 10 may consist of a pair of units respectively positioned along the continuous passage of yarns SHa/SHa/. . . and warp SH in such a manner that when the first abnormality detection means 10 at the upstream side detects an abnormality, the warper is slowed down according to any of the procedures shown in FIGS. 5 through 7. When the second abnormality detection means 10 at the downstream side detects the abnormality the warper is stopped. Since the abnormal portion is at the immediate downstream side of the second abnormality detection means 10 when the warper stops, it is easy for an operator to search for and repair the abnormal portion.

Having described preferred embodiments of the invention with reference to the accompanying drawings, it is to be understood that the invention is not limited to those precise embodiments, and that various changes and modifications may be effected therein by one skilled in the art without departing from either the scope or spirit of the invention as defined in the appended claims.

What is claimed is:

1. A device for controlling a braking distance of a yarn, comprising:

means for moving said yarn along a path in a forward direction;

means for detecting an abnormality in said yarn along said path;

means, responsive to said means for detecting, for generating a stop signal to stop said yarn;

means for measuring a distance travelled by said yarn along said path following generation of said stop signal;

means for controlling said means for moving including means for stopping movement of said yarn at a braking distance;

means for determining a difference distance between said braking distance and a predetermined distance associated with the means for controlling; and means for controlling said means for moving further including means for regulating a speed of said yarn moving along said path whereby, in response to said yarn being stopped, said yarn is moved along said path at a slow speed for said difference distance and then stopped substantially equal to said predetermined distance.

2. A device for controlling a braking distance of a yarn, comprising:

means for moving said yarn along a path in a first direction;

means for detecting an abnormality in said yarn along said path;

means, responsive to said means for detecting, for generating a stop signal to stop said yarn;

means for measuring a distance travelled by said yarn along said path following generation of said stop signal;

means for controlling said means for moving including means for stopping movement of said yarn at a braking distance substantially equal to a predetermined distance associated with the means for controlling;

means for moving said yarn in a second direction;

a brake associated with each of the means for moving;

said means for controlling further including means for comparing said braking distance with said predetermined distance;

said means for controlling further including means for engaging said means for moving said yarn in said first direction responsive to when said braking distance is less than said predetermined distance;

said means for controlling further including means for engaging said means for moving said yarn in said second direction responsive to when said braking distance is greater than said predetermined distance; and said means for controlling further including means for actuating said brake when said braking distance is substantially equal to said predetermined distance.

3. A device for controlling a braking distance of a yarn, comprising:

means for moving said yarn along a path in a first direction;

means for detecting an abnormality in said yarn along said path;

means, responsive to said means for detecting, for generating a stop signal to stop said yarn;

means for measuring a distance travelled by said yarn along said path following generation of said stop signal;

means for controlling said means for moving including means for stopping movement of said yarn at a braking distance substantially equal to a predetermined stopping distance associated with the means for controlling;

means for moving said yarn in a second direction;

a brake associated with each of the means for moving;

said means for controlling further including means for comparing said distance travelled following generation of said stop signal with said predetermined stopping distance;

said means for controlling further including means for engaging said means for moving said yarn in first direction responsive to when said distance travelled is less than said predetermined distance;

said means for controlling further including means for engaging said means for moving said yarn in second direction responsive to when said distance travelled is greater than said predetermined distance;

said means for controlling further including means for actuating said brake when said distance travelled is substantially equal to said predetermined distance; and an accumulator along said path including means for preventing sagging of said yarn, downstream of said means for detecting when said means for moving said yarn in said second direction moves said yarn in said second direction.

* * * * *